US005829337A

United States Patent [19]

Barden

[11] Patent Number: 5,829,337

[45] Date of Patent: Nov. 3, 1998

[54] METHOD AND APPARATUS FOR COUPLING A FLUID-POWERED IMPLEMENT TO A WORK MACHINE

[75] Inventor: William Mark Barden, Raleigh, N.C.

[73] Assignee: Caterpillar Inc., Peoria, Ill.

[21] Appl. No.: 922,112

[22] Filed: Aug. 28, 1997

[51] Int. Cl.[6] ..... F15B 13/02

[52] U.S. Cl. ..... 91/432; 137/595; 137/614.04; 285/26

[58] Field of Search ..... 91/432; 137/595, 137/614.04; 285/26, 29, 124.1

[56] References Cited

U.S. PATENT DOCUMENTS

| | | | |
|---|---|---|---|
| 2,887,124 | 5/1959 | Mehl . | |
| 2,930,633 | 3/1960 | Ethington et al. | 137/614.04 |
| 3,174,508 | 3/1965 | Zahuranec | 137/614.04 |
| 3,527,480 | 9/1970 | Larson | 285/124.1 |
| 3,656,781 | 4/1972 | Paine et al. . | |
| 3,865,013 | 2/1975 | Mastaj | 91/432 |
| 4,615,546 | 10/1986 | Nash et al. | 285/26 |
| 4,915,419 | 4/1990 | Smith, III | 285/26 |
| 4,938,651 | 7/1990 | Gilmor et al. . | |
| 4,953,592 | 9/1990 | Takahashi et al. | 91/432 |
| 5,092,364 | 3/1992 | Mullins | 285/29 |
| 5,141,386 | 8/1992 | Barwise | 137/595 |
| 5,167,464 | 12/1992 | Voellmer . | |
| 5,581,917 | 12/1996 | Barden . | |

FOREIGN PATENT DOCUMENTS

| | | |
|---|---|---|
| WO 91/01413 | 2/1991 | European Pat. Off. . |
| WO 91/01414 | 2/1991 | European Pat. Off. . |

*Primary Examiner*—F. Daniel Lopez
*Attorney, Agent, or Firm*—Paul J. Maginot

[57] ABSTRACT

A method of coupling a fluid-powered work implement to a boom assembly of a work machine is disclosed. The boom assembly has a first male fluid coupling attached thereto. The boom assembly also has a plunger attached thereto. The work implement has a first female fluid coupling attached thereto. The first female fluid coupling has a first locking sleeve slidably secured thereto. The method includes the step of moving the boom assembly toward the work implement so as to align the first male fluid coupling with the first female fluid coupling. The method also includes the step of actuating the plunger so as to cause the first locking sleeve to be moved from a first locked position to a first unlocked position. Moreover, the method includes the step of further moving the boom assembly so as to advance the first male fluid coupling into the first female fluid coupling. The method further includes the step of deactuating the plunger so as to cause the first locking sleeve to be moved from the first unlocked position to the first locked position. An apparatus for coupling a fluid-powered implement to a work machine is also disclosed.

20 Claims, 9 Drawing Sheets

METHOD AND APPARATUS FOR COUPLING A FLUID-POWERED IMPLEMENT TO A WORK MACHINE

TECHNICAL FIELD OF THE INVENTION

The present invention relates generally to a work machine, and more particularly to an apparatus and method for coupling a fluid-powered implement to a work machine.

BACKGROUND OF THE INVENTION

Work machines, such as tool carriers, are often equipped with a fluid-powered implement, such as a hydraulically-powered sweeper assembly or a hydraulically-powered grapple. The implement is mechanically coupled to the work machine via a boom linkage. In particular, the boom linkage is coupled at a first end to a chassis of the work machine, and at a second end to the fluid-powered implement.

Fluid pressure from a fluid power circuit associated with the work machine provides the operative power for operating the implement. In the case of a hydraulically-powered sweeper assembly, a hydraulic motor powers or otherwise rotates a broom included in the sweeper assembly. The hydraulic motor is coupled to the fluid power circuit of the work machine. In particular, a fluid outlet line from a high pressure fluid pump included in the fluid power circuit of the work machine is coupled to a fluid inlet line of the sweeper assembly's hydraulic motor via a first male-to-female hydraulic coupling. Similarly, a fluid outlet line of the sweeper assembly's hydraulic motor is coupled to a reservoir or drain included in the fluid power circuit of the work machine via a second male-to-female hydraulic coupling.

During operation of the tool carrier, it is often desirable to exchange the work implement that is attached to the boom assembly. For example, it may desirable to disconnect the sweeper assembly in order to attach the grapple to the boom assembly. Disconnecting one work implement (e.g. the sweeper assembly) and a attaching a different work implement (e.g. the grapple) is often a difficult and time consuming task. In particular, an operator of the work machine must leave the cab of the work machine, disconnect the male and female fluid couplings from one another, and then disconnect a number of pins, bolts, or other types of fasteners which are provided to mechanically couple the sweeper assembly to the boom assembly. The operator must then mechanically couple the grapple to the work machine by reconnecting the pins and bolts associated with the grapple. Thereafter, the operator must reconnect the respective male and female fluid couplings to one another thereby placing the grapple in fluid communication with the fluid control circuit associated with the work machine. It should be appreciated that during the period of time required to change or swap the implements, the work machine is idle thereby disadvantageously decreasing the efficiency or productivity of the work machine.

In order to quickly mechanically connect and/or disconnect work implements, a number of "quick coupling devices" have heretofore been designed. Such quick coupling devices typically include an apparatus which can quickly and easily mechanically connect and/or disconnect the work implement to and/or from the boom assembly. One such quick coupling device is disclosed in U.S. Pat. No. 5,581,917 which is issued to Barden, and assigned to the same assignee as the present invention. While use of such quick coupling devices is advantageous in reducing the amount of time needed to mechanically connect and/or disconnect the implement to and/or from the boom assembly, additional measures must still be taken in order to couple and/or decouple the male and female fluid couplings associated with a fluid-powered work implement. More specifically, even if the work machine is equipped with one of the quick coupling devices which have heretofore been designed, the operator of the work machine must still leave the cab of the work machine to couple and/or decouple the male and female fluid couplings associated with the fluid-powered implement.

What is needed therefore is a method and apparatus for coupling a fluid-powered implement to a work machine. What is further needed is an method and apparatus for coupling a fluid-powered implement to a work machine that does not require the operator to leave the cab of the work machine.

SUMMARY OF THE INVENTION

In accordance with a first embodiment of the present invention, there is provided a work machine. The work machine includes a boom assembly and a fluid-powered work implement. The work machine also includes a first male fluid coupling secured to the boom assembly. The work machine further includes a plunger movably secured to the boom assembly. The plunger is positionable between a first plunger position and a second plunger position. The work machine also includes a first female fluid coupling secured to the work implement. The first female fluid coupling has a first locking sleeve slidably secured thereto so as to be positionable between a first locked position and a first unlocked position. The plunger positions the first locking sleeve in the first unlocked position when the plunger is positioned in the first plunger position. The plunger allows the first locking sleeve to assume the first locked position when the plunger is positioned in the second plunger position.

In accordance with a second embodiment of the present invention, there is provided a method of coupling a fluid-powered work implement to a boom assembly of a work machine. The boom assembly has a first male fluid coupling attached thereto. The boom assembly also has a plunger attached thereto. The work implement has a first female fluid coupling attached thereto. The first female fluid coupling has a first locking sleeve slidably secured thereto. The method includes the step of moving the boom assembly toward the work implement so as to align the first male fluid coupling with the first female fluid coupling. The method also includes the step of actuating the plunger so as to cause the first locking sleeve to be moved from a first locked position to a first unlocked position. Moreover, the method includes the step of further moving the boom assembly so as to advance the first male fluid coupling into the first female fluid coupling. The method further includes the step of deactuating the plunger so as to cause the first locking sleeve to be moved from the first unlocked position to the first locked position.

In accordance with a third embodiment of the present invention, there is provided a work machine. The work machine includes a first machine component, and a second machine component. The work machine also includes a first fluid coupling secured to the first machine component. The work machine further includes a plunger movably secured to the first machine component. The plunger is positionable between a first plunger position and a second plunger position. Moreover, the work machine includes a second fluid coupling secured to the second machine component. The second fluid coupling being positionable between a locked position and an unlocked position. The plunger positions the second fluid coupling in the first unlocked position when the plunger is positioned in the first plunger position. The plunger allows the second fluid coupling to assume the first locked position when the plunger is positioned in the second plunger position.

BEST MODE FOR CARRYING OUT THE INVENTION

Figure 1:
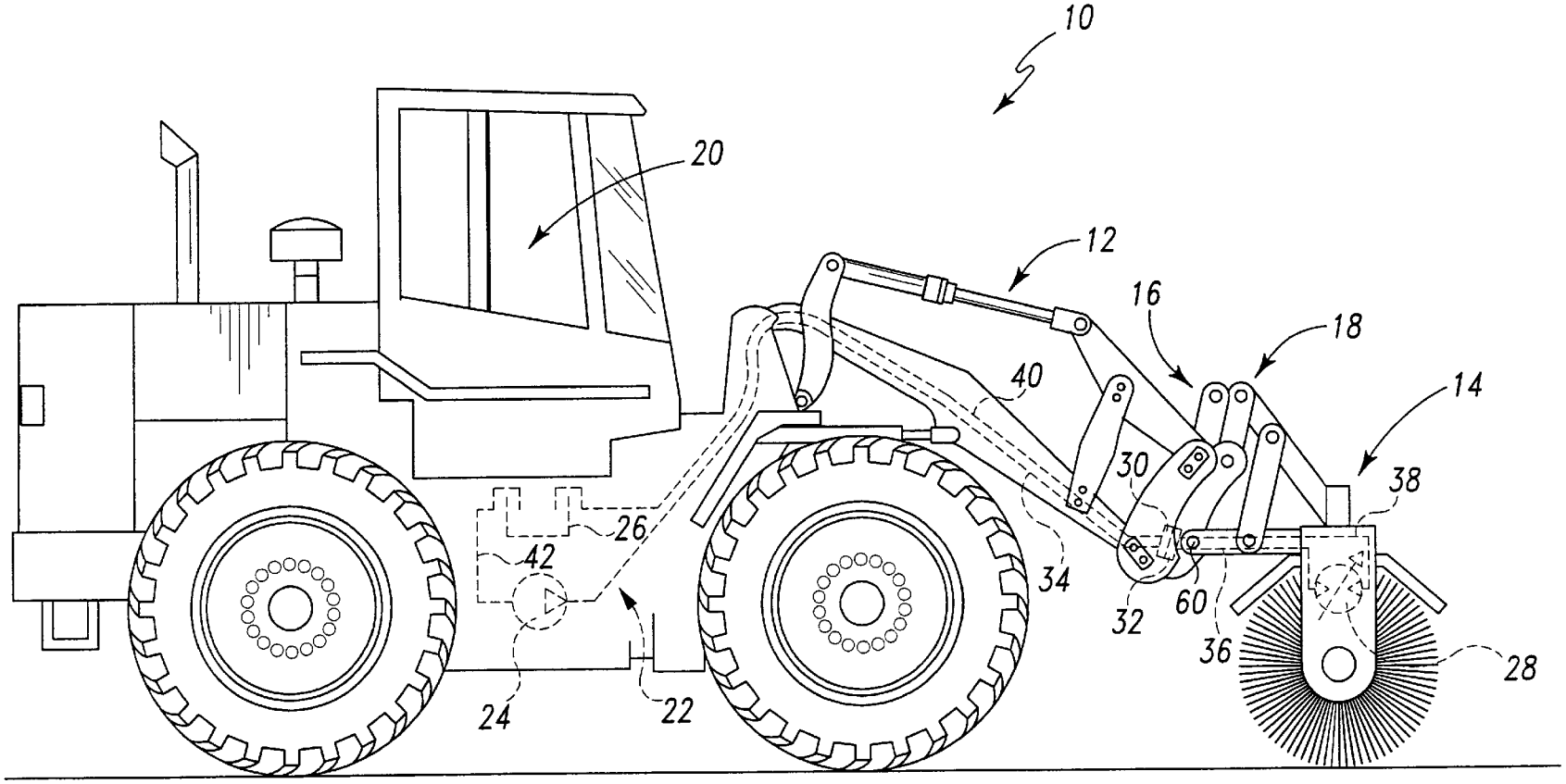
FIG. 1 is a side elevational view of a work machine which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown a work machine 10 such as a tool carrier. The tool carrier 10 includes a boom assembly 12 having a fluid-powered work implement 14, such as a hydraulically-powered sweeper assembly, secured thereto. In particular, the boom assembly 12 includes a mechanical coupling assembly 16, whereas the sweeper assembly 14 includes a mechanical coupling assembly 18. The mechanical coupling assembly 16 may be a known quick coupling assembly thereby allowing the sweeper assembly 14 to be mechanically coupled to the boom assembly 12 without requiring an operator (not shown) of the tool carrier 10 to leave a cab portion 20 thereof. One quick coupling assembly that may be used with minor modification as the mechanical coupling assembly 16 of the present invention is disclosed in U.S. Pat. No. 5,581,917 issued to Barden, the disclosure of which is hereby incorporated by reference.

The tool carrier 10 further includes a fluid control circuit 22. The fluid control circuit 22 includes a fluid pump 24 and a reservoir 26. The fluid control circuit 22 provides the operative power necessary to drive or otherwise power a hydraulic motor 28 included in the sweeper assembly 14. As shown in FIG. 1, a male fluid coupling assembly 30 is secured to the mechanical coupling assembly 16 of the boom assembly 12, whereas a female fluid coupling assembly 32 is secured to the mechanical coupling assembly 18 of the sweeper assembly 14. An outlet of the fluid pump 24 is coupled to the male fluid coupling assembly 30 via a fluid line 34, whereas the female fluid assembly 32 is coupled to an inlet of the hydraulic motor 28 via fluid line 36. Hence, when the male fluid coupling assembly 30 is coupled to the female fluid coupling assembly 32, the outlet of the fluid pump 24 is in fluid communication with the inlet of the hydraulic motor 28 via a fluid path which includes the fluid line 34, the male fluid coupling assembly 30, the female fluid assembly 32, and the fluid line 36.

An outlet of the hydraulic motor 28 is coupled to the female fluid coupling assembly 32 via a fluid line 38, whereas the male fluid coupling assembly 30 is coupled to the reservoir 26 via a fluid line 40. Hence, when the male fluid coupling assembly 30 is coupled to the female fluid coupling assembly 32, the outlet of the hydraulic motor 28 is in fluid communication with the reservoir 26 via a fluid path which includes the fluid line 38, the female fluid coupling assembly 32, the male fluid assembly 30, and the fluid line 40. In addition, the reservoir 26 is coupled to an inlet of the fluid pump 24 via a fluid line 42 in order to complete the fluid control circuit 22.

Referring now to FIGS. 2–5, the male fluid coupling assembly 30 and the female fluid coupling assembly 32 are shown in more detail. The female fluid coupling assembly 32 includes a pair of female fluid couplings 44, 46 (see FIG. 3), whereas the male fluid coupling assembly includes a pair of male fluid couplings 48, 50 (see FIG. 5). The female fluid coupling 44 is coupled to the fluid line 38 (see FIG. 1), whereas the female fluid coupling 46 is coupled to the fluid line 36 (see FIG. 1). Moreover, the male fluid coupling 48 is coupled to the fluid line 34 (see FIG. 1), whereas the male fluid coupling 50 is coupled to the fluid line 40.

Figure 3:
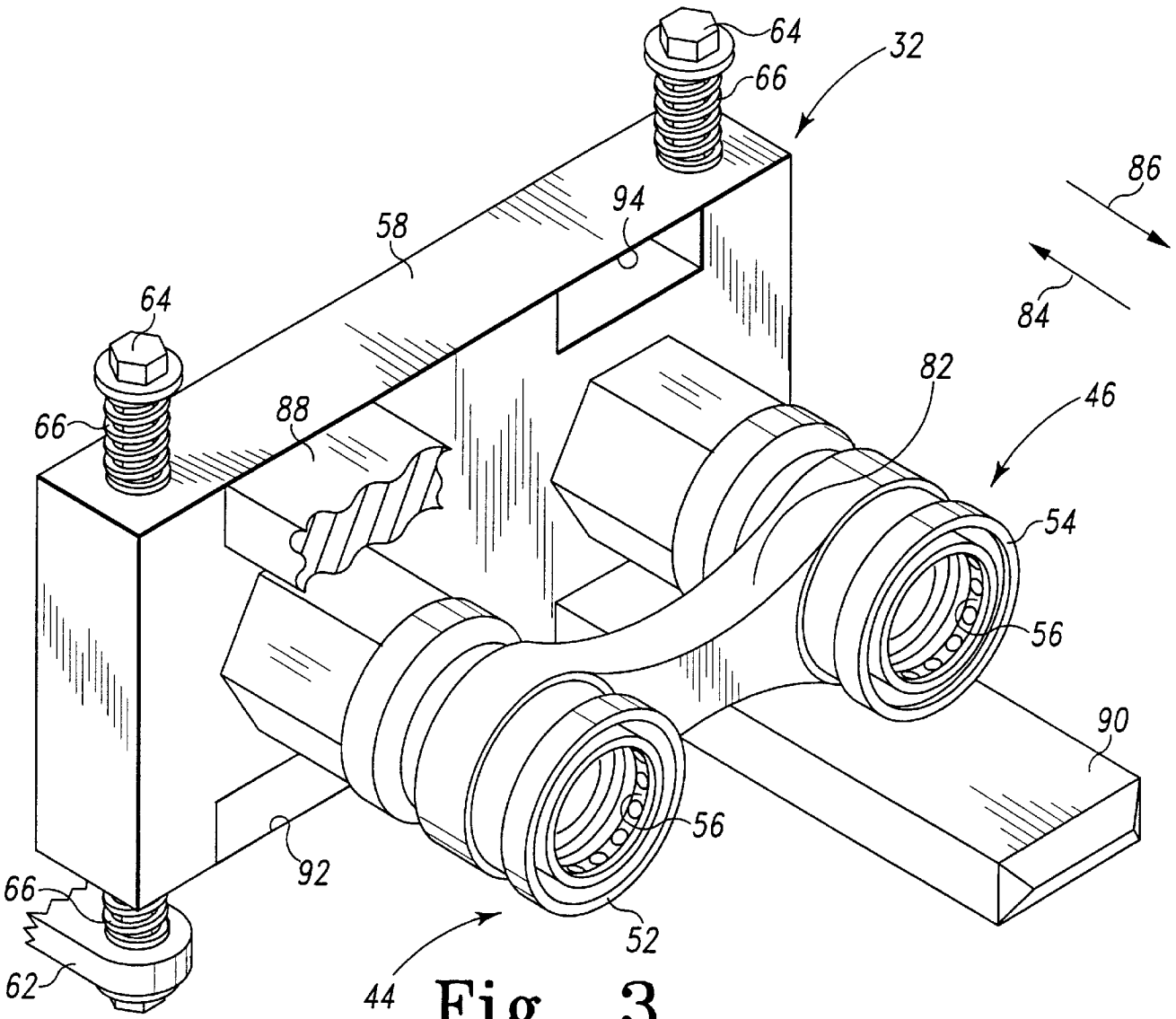
FIG. 3 is a perspective view of the female fluid coupling assembly of FIG. 2, with the female fluid couplings being shown in the locked position, note that the alignment finger 88 has been partially cut away for clarity of description.

Slidably secured to each of the female fluid couplings 44, 46 is a locking sleeve 52, 54, respectively. Each of the locking sleeves 52, 54 may be moved between a respective locked position (see FIG. 3) and a respective unlocked position (see FIG. 4). The locking sleeves 52, 54 are each biased by a locking spring (not shown) included in the female fluid couplings 44, 46, respectively, which urges or otherwise biases the locking sleeves 52, 54 into their respective locked position as shown in FIG. 3. Therefore, as shall be discussed below in more detail, the locking sleeves 52, 54 remain in their respective locked position until urged or otherwise moved into their respective unlocked position.

Moreover, each of the female fluid couplings 44, 46 and the male fluid couplings 48, 50 includes a number of balls (not shown) or the like in order to selectively inhibit the advancement of fluid therebetween. In particular, the female fluid couplings 44, 46 and the male fluid couplings 48, 50 are each configured so as to allow the advancement of fluid therebetween only when the male fluid couplings 48, 50 are coupled to the female fluid couplings 46, 44, respectively. What is meant herein by the term "coupled" is that (1) the male fluid couplings 48, 50 are positioned in an open ended chamber 56 (see FIGS. 2 and 3) defined in each of the female fluid couplings 46, 44, respectively, and (2) the locking sleeves 52, 54 are positioned in their respective locked positions.

It should therefore be appreciated that fluid is inhibited from being advanced through the male fluid couplings 48, 50 prior to (1) advancement thereof into the open ended chambers 56 of the female fluid couplings 46, 44, respectively, and (2) positioning the locking sleeves 52, 54 into their respective locked positions. Moreover, it should be further appreciated that fluid is inhibited from being advanced through the female fluid couplings 44, 46 prior to (1) advancement of the male fluid couplings 48, 50 into the open ended chambers 56 of the female fluid couplings 46, 44, respectively, and (2) positioning the locking sleeves 52, 54 into their respective locked positions.

Various types and configurations of the female fluid couplings 44, 46, and the male fluid couplings 48, 50 are contemplated for use in the present invention. One type of female fluid coupling which is suitable for use as the female fluid couplings 44, 46 in the present invention is a part number 6W-2889 Coupling Assembly which is commercially available from Caterpillar, Incorporated of Peoria, Ill. Moreover, one type of male fluid coupling which is suitable for use as the male fluid couplings 48, 50 in the present invention is a part number 6W-2888 Nipple Assembly which is also commercially available from Caterpillar, Incorporated.

It should be appreciated that a solenoid-controlled fluid valve (not shown) may also be included in the fluid control circuit 22 in order to isolate the male fluid coupling assembly 30 from the fluid pump 24 and the fluid reservoir 26 during an attachment or detachment procedure. In particular, the solenoid-controlled fluid valve may be positioned between the male fluid coupling assembly 30 and the fluid pump 24 and the fluid reservoir 26 such that when positioned in a closed position the valve inhibits advancement of fluid in the fluid lines 34 and 40 thereby isolating the male fluid coupling assembly 30 from the fluid pump 24 and the fluid reservoir 26.

From a location in the cab portion 20, the operator of the tool coupler 10 may press a button or the like which actuates the solenoid-controlled fluid valve during an attachment or detachment procedure (i.e. attachment or detachment of the sweeper assembly 14). After completion of the procedure, the operator may then release the button thereby causing the solenoid-controlled fluid valve to assume an open position in which fluid may be advanced to and from the male fluid coupling assembly 30 via the fluid lines 34 and 40. It should be appreciated that use of the solenoid-controlled fluid valve in such a manner reduces the occasions in which fluid is inadvertently spilled out of the male fluid coupling assembly 30 during an attachment or detachment procedure.

Figure 2:
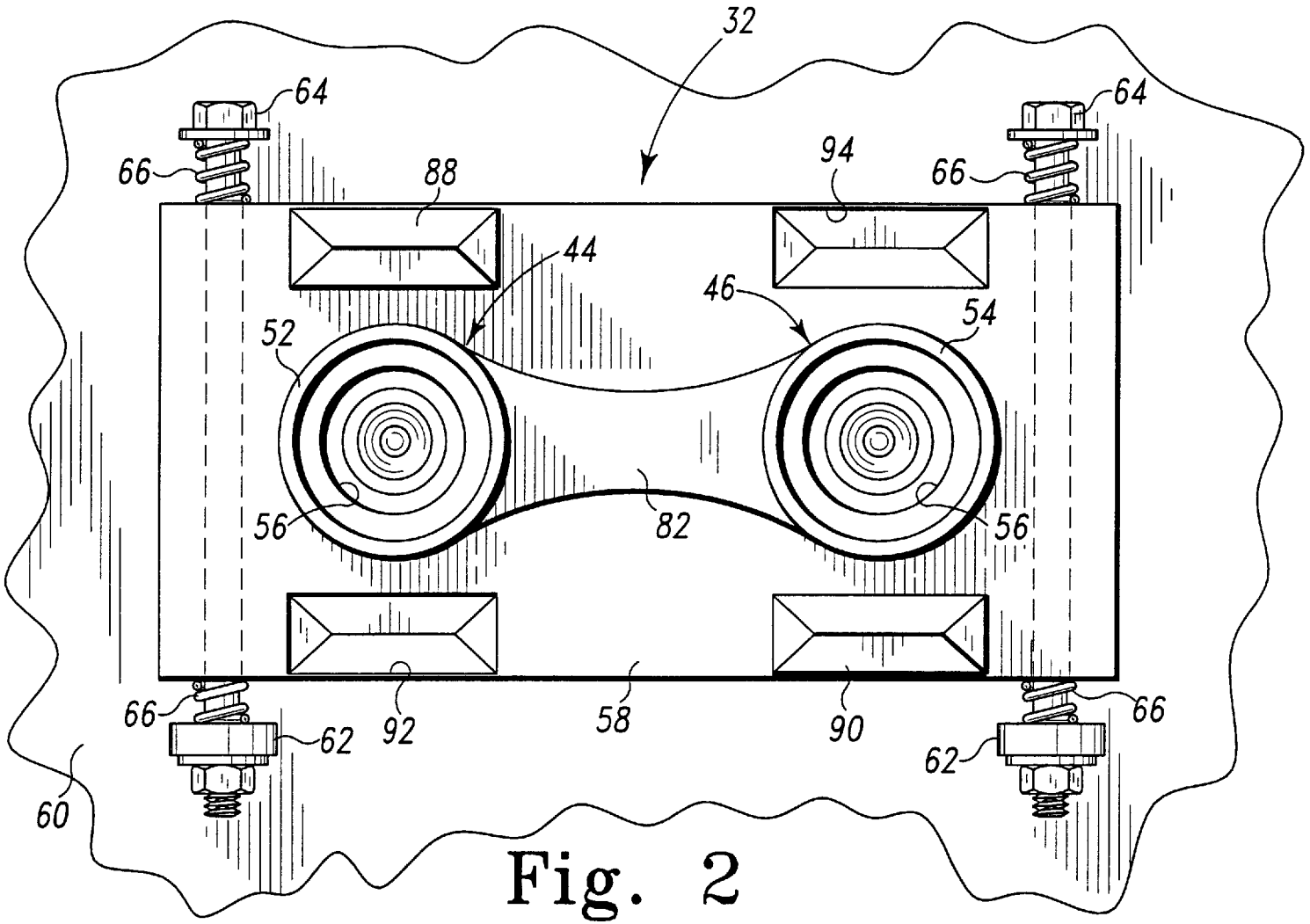
FIG. 2 is a front elevational view of the female fluid coupling assembly of the work machine of FIG. 1.
Figure 4:
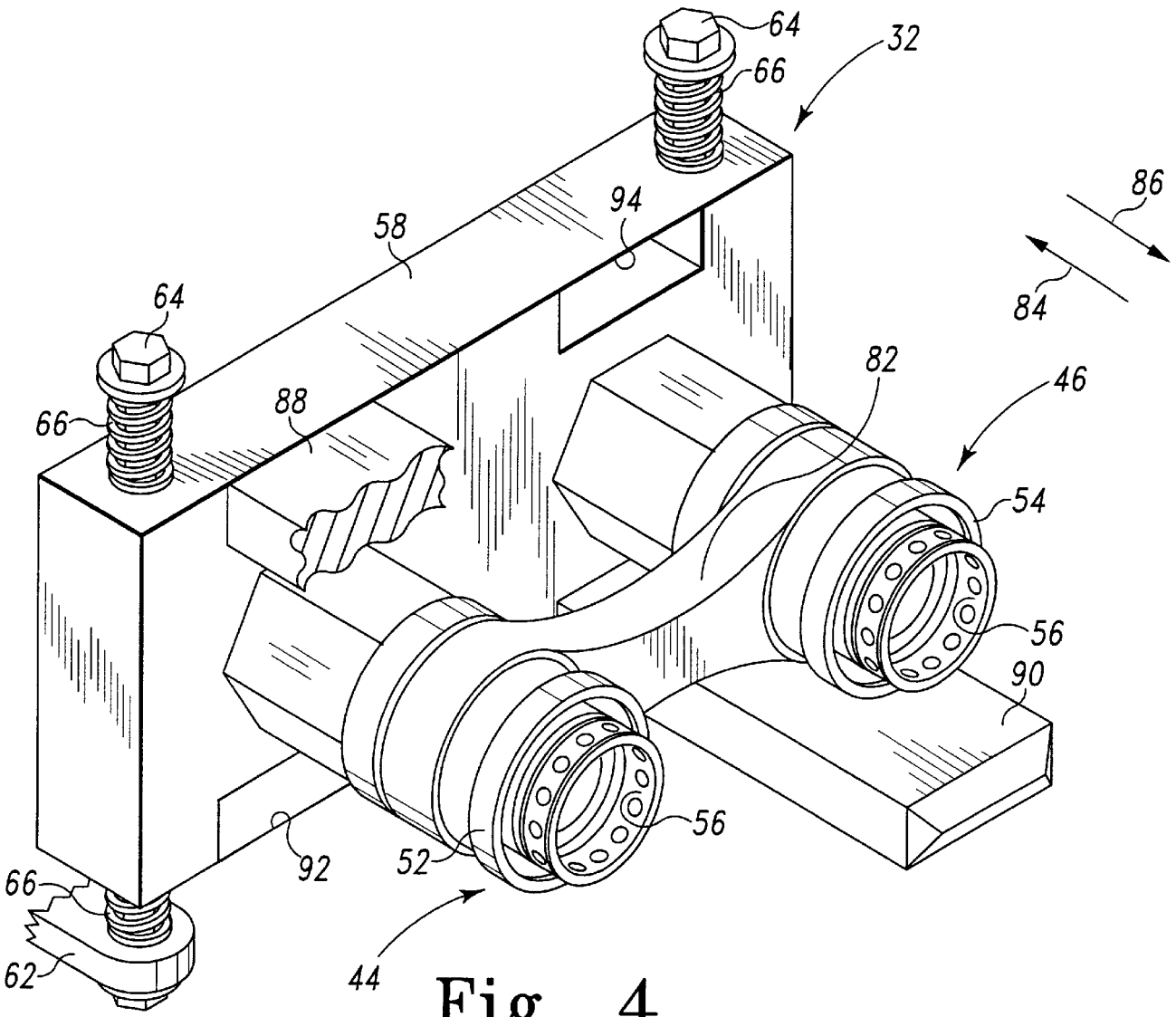
FIG. 4 is a view similar to FIG. 3, but showing the female fluid couplings in the unlocked position.

As shown in FIGS. 2–4, the female fluid couplings 44, 46 are secured to a base plate 58. The base plate 58 is in turn movably secured to a support member 60 included in the mechanical coupling assembly 18 of the sweeper assembly 14 (see FIG. 1). In particular, the base plate 58 is secured to a pair of tabs 62 attached to the support member 60 via a pair of bolts 64. A number of locating springs 66 are concentrically disposed on the bolts 64 thereby allowing the base plate 58 to move upwardly and downwardly relative to the support member 60. As shall be discussed further below, such movement facilitates alignment of the female fluid couplings 44, 46 relative to the male fluid couplings 48, 50 as the male fluid couplings 48, 50 are being advanced into the open ended chambers 56 of the female fluid couplings 46, 44, respectively.

Figure 5:
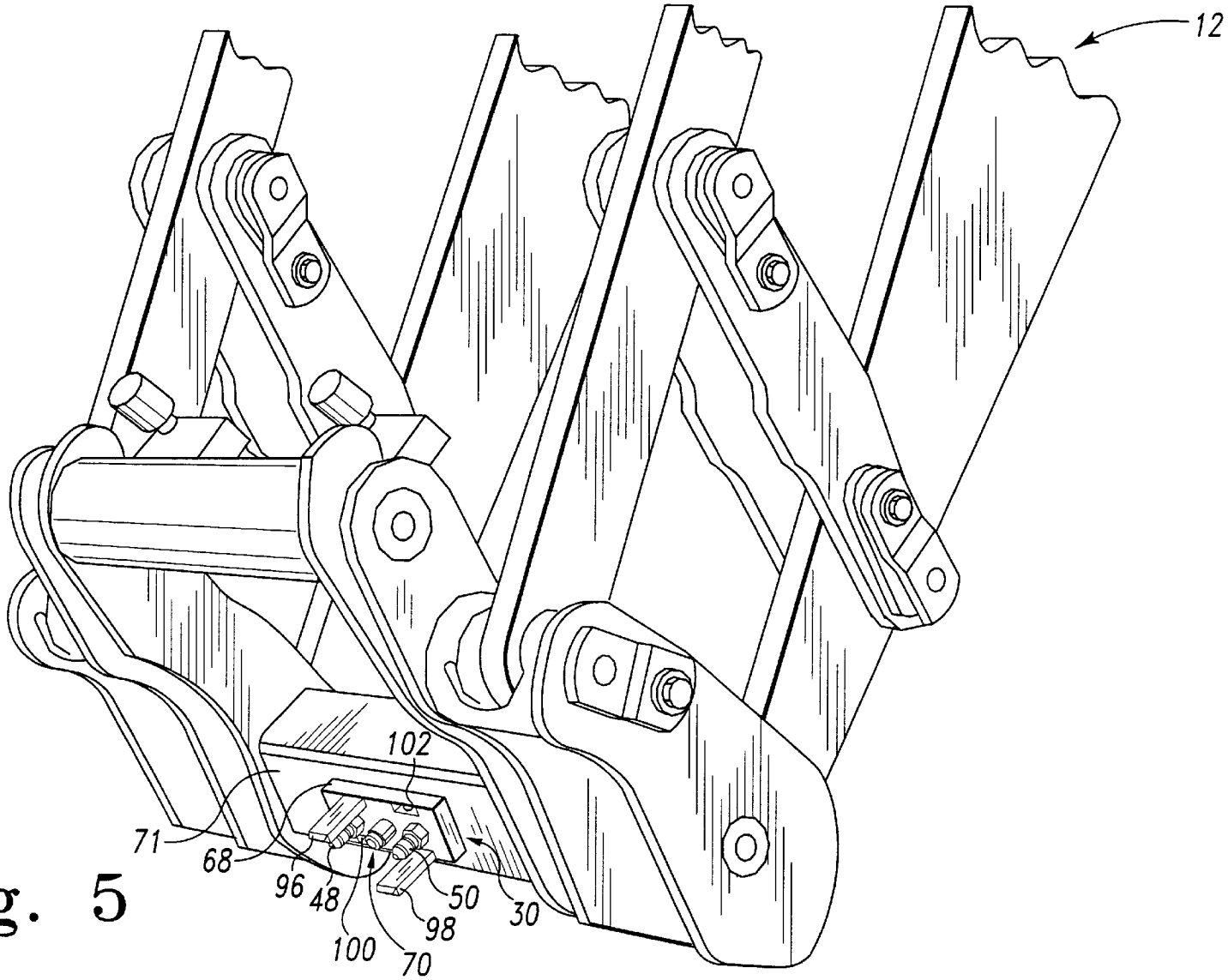
FIG. 5 is a fragmentary perspective view of the work machine of FIG. 1 showing the relationship between the boom assembly and the male fluid coupling assembly.

Similarly, as shown in FIG. 5, the male fluid couplings 48, 50 are secured to a base plate 68. The base plate 68 is in turn non-movably secured to a support member 71 included in the mechanical coupling assembly 16 of the boom assembly 12 (see FIGS. 1 and 5). It should therefore be appreciated that the base plate 68 and hence the male fluid couplings 48, 50 are moved dependently with movement of the boom assembly 12. As shall be discussed further below, such movement facilitates alignment of the male fluid couplings 48, 50 relative to the female fluid couplings 44, 46 as the male fluid couplings 48, 50 are being advanced into the open ended chambers 56 of the female fluid couplings 46, 44, respectively, during attachment of the sweeper assembly 14.

Figure 6:
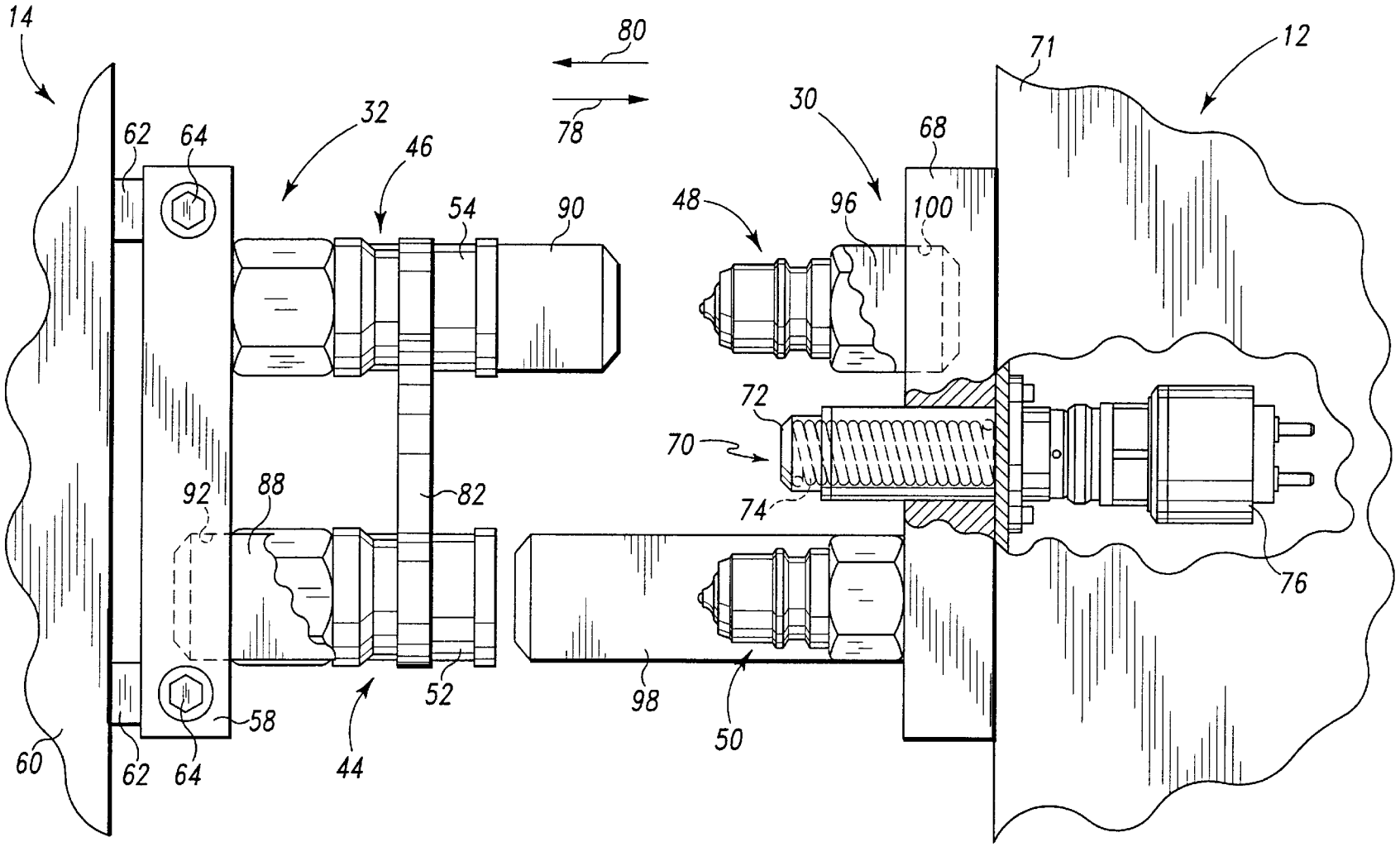
FIG. 6 is a top elevational view showing the male fluid couplings of FIG. 5 aligned with the female fluid couplings of FIG. 2, note that the alignment fingers 88, 96 have been partially cut away for clarity of description.

As shown in FIGS. 5 and 6, the male fluid coupling assembly 30 further includes a plunger assembly 70. The plunger assembly 70 includes a plunger 72, a plunger spring 74, and a solenoid 76. The plunger 72 is movable between a retracted position (see FIG. 6), and an extended position (see FIG. 8). In particular, spring bias generated by the spring 74 urges the plunger 72 in the general direction of arrow 78 of FIGS. 6–9 thereby positioning the plunger 72 in the retracted position, as shown in FIG. 6. Actuation of the solenoid 76 causes the plunger 72 to be moved from the retracted position to the extended position. More specifically, when the solenoid 76 is actuated, an actuating arm (not shown) associated with the solenoid 76 urges the plunger 72 in the general direction of arrow 80 of FIGS. 6–9. The force exerted on the plunger 72 by the actuating arm of the solenoid 76 is greater in magnitude than the spring bias of the spring 74 thereby causing the plunger 72 to be urged in the general direction of arrow 80 so as to position the plunger 72 in the extended position as shown in FIG. 8. When the solenoid 76 is deactuated, spring bias generated by the spring 74 returns the plunger 72 to the retracted position as shown in FIG. 6.

The plunger assembly 70 is provided to selectively position the locking sleeves 52, 54 of the female fluid couplings 44, 46 into either their respective locked positions (see FIG. 3), or their respective unlocked positions (see FIG. 4). In particular, a first end of a release member or bar 82 is secured to the locking sleeve 52, whereas a second end of the release bar 82 is secured to the locking sleeve 54. Hence, movement of the release bar 82 in the general direction of arrow 84 of FIGS. 3 and 4 causes the locking sleeves 52, 54 to be likewise moved in the general direction of arrow 84 thereby positioning the locking sleeves 52, 54 into their respective unlocked positions as shown in FIG. 4. Therefore, it should be appreciated that when the male fluid coupling assembly 30 is positioned proximate the female fluid coupling assembly 32, the plunger 72 may be positioned in the extended position so as to urge the release bar 82 in the general direction of arrow 84 thereby positioning the locking sleeves 52, 54 into their respective unlocked positions as shown in FIG. 4.

When the plunger 72 is spaced apart or otherwise disengaged from the release bar 82, the spring bias generated by the locking springs (not shown) of the female fluid couplings 44, 46 urges the locking sleeves 52, 54 and hence the release bar 82 in the general direction of arrow 86 thereby positioning the locking sleeves 52, 54 into their respective locked positions as shown in FIG. 3.

As shown in FIGS. 2–4, the base plate 58 of the female fluid coupling assembly 32 has a pair of alignment fingers 88, 90 secured thereto. Moreover, the base plate 58 has a pair of alignment recesses 92, 94 defined therein. Similarly, as shown in FIGS. 5 and 6, the base plate 68 of the male fluid coupling assembly 30 has a pair of alignment fingers 96, 98 secured thereto. In addition, the base plate 68 has a pair of alignment recesses 100, 102 defined therein. As shall be discussed below in more detail, (1) the alignment fingers 88, 90 cooperate with the alignment recesses 102, 100, and (2) the alignment fingers 96, 98 cooperate with the alignment recesses 94, 92 in order to align the male fluid coupling assembly 30 with the female fluid coupling assembly 32. In particular, the male fluid couplings 48, 50 are aligned with the female fluid couplings 46, 44, respectively, in order to be advanced into the respective open ended chambers 56 thereof when: (1) the alignment finger 88 is received into the alignment recess 102, (2) the alignment finger 90 is received into the alignment recess 100, (3) the alignment finger 96 is received into the alignment recess 94, and (4) the alignment finger 98 is received into the alignment recess 92.

It should be appreciated that the mechanical coupling assembly 16 of the boom assembly 12 (see FIG. 1), and the mechanical coupling assembly 18 of the sweeper assembly 14 (see FIG. 1) may be also be configured with alignment devices (e.g. alignment pins and fingers along with corresponding apertures or recesses) for aligning the boom assembly 12 with the sweeper assembly 14. During an attachment operation, such alignment devices would cooperate to align the boom assembly 12 with the sweeper assembly 14 thereby positioning the male fluid coupling assembly 30 (see FIG. 5) in near alignment with the female fluid coupling assembly 32. What is meant herein by the term "near alignment" is that the male fluid coupling assembly 30 is positioned relative to the female fluid coupling assembly 32 such that the alignment fingers 88, 90, 96, 98 may be advanced into the alignment recess 102, 100, 94, 92, respectively, upon further advancement of the male fluid coupling assembly 30. Thereafter, as the boom assembly 12 continues to be advanced toward the sweeper assembly 14, the alignment fingers 88, 90, 96, 98 cooperate with the alignment recess 102, 100, 94, 92, respectively, so as to more precisely align the male fluid couplings 48, 50 with the female fluid couplings 46, 44, respectively. It should be appreciated that during such precise alignment, the locating springs 66 (see FIG. 2) allow the base plate 58 of the female fluid assembly 32 to be moved over a limited distance of travel relative the support member 60 so as to facilitate the alignment of the male fluid couplings 48, 50 with the female fluid couplings 46, 44.

INDUSTRIAL APPLICABILITY

In operation, during a coupling operation, the boom assembly 12 is first moved relative the sweeper assembly 14. In particular, as shown in FIG. 6, the boom assembly 12 is positioned such that the male fluid coupling assembly 30 is positioned proximate the female coupling assembly 32. As the male fluid coupling assembly 30 is advanced in the general direction of arrow 80 of FIG. 6, components associated with the mechanical coupling assembly 16 (see FIG. 1) begin to align with the mechanical coupling assembly 18 of the sweeper assembly (see FIG. 1). Such alignment of the mechanical coupling assemblies 16, 18 places the male fluid coupling assembly 30 in near alignment with the female fluid coupling assembly 32.

Figure 7:
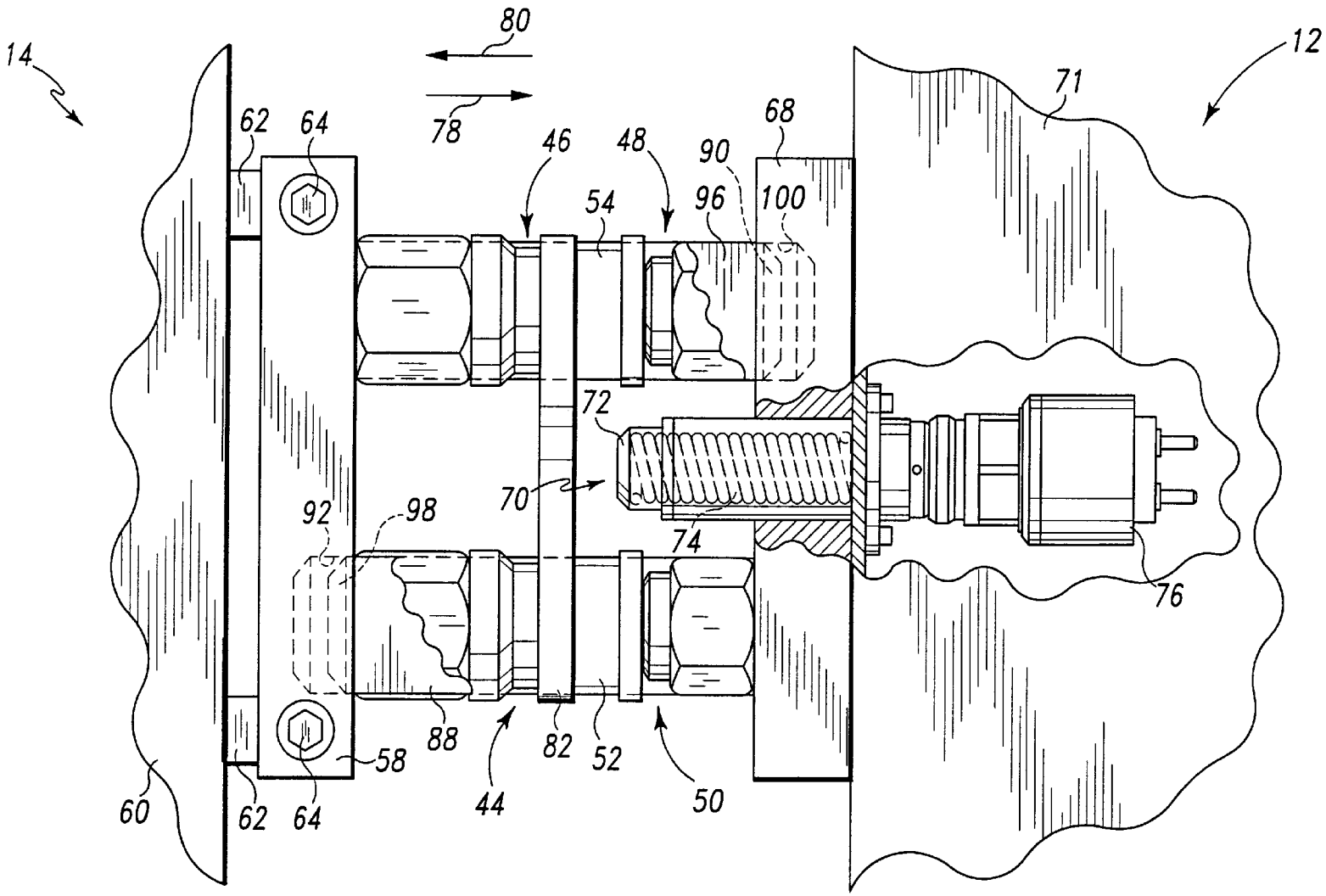
FIG. 7 is a view similar to FIG. 6, but showing the male fluid couplings being advanced into the female fluid couplings while the alignment fingers are being received into the alignment recesses
Figure 8:
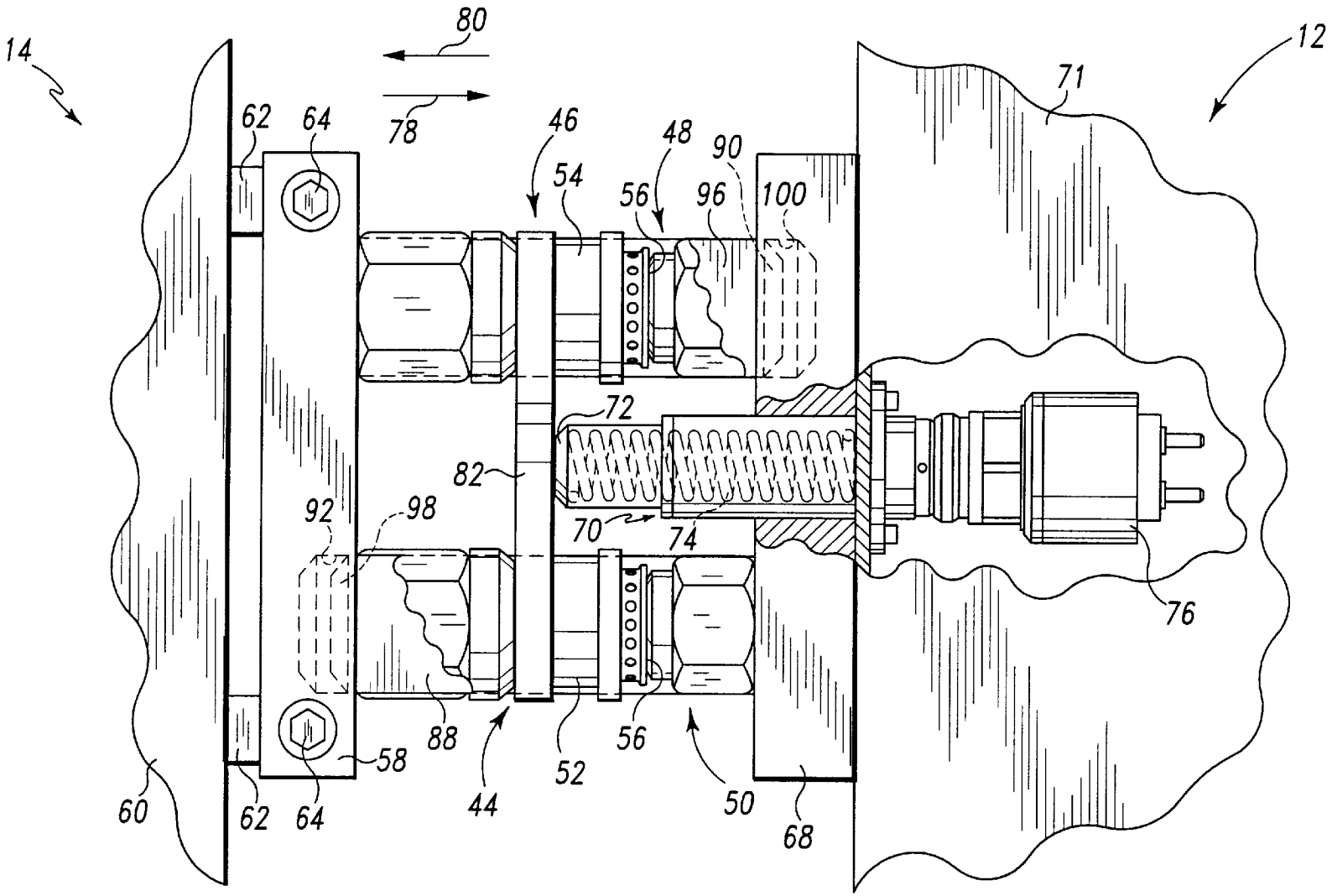
FIG. 8 is a view similar to FIG. 6, but showing the plunger of the male fluid coupling assembly in the extended position so as to contact the release bar of the female fluid coupling assembly.
Figure 9:
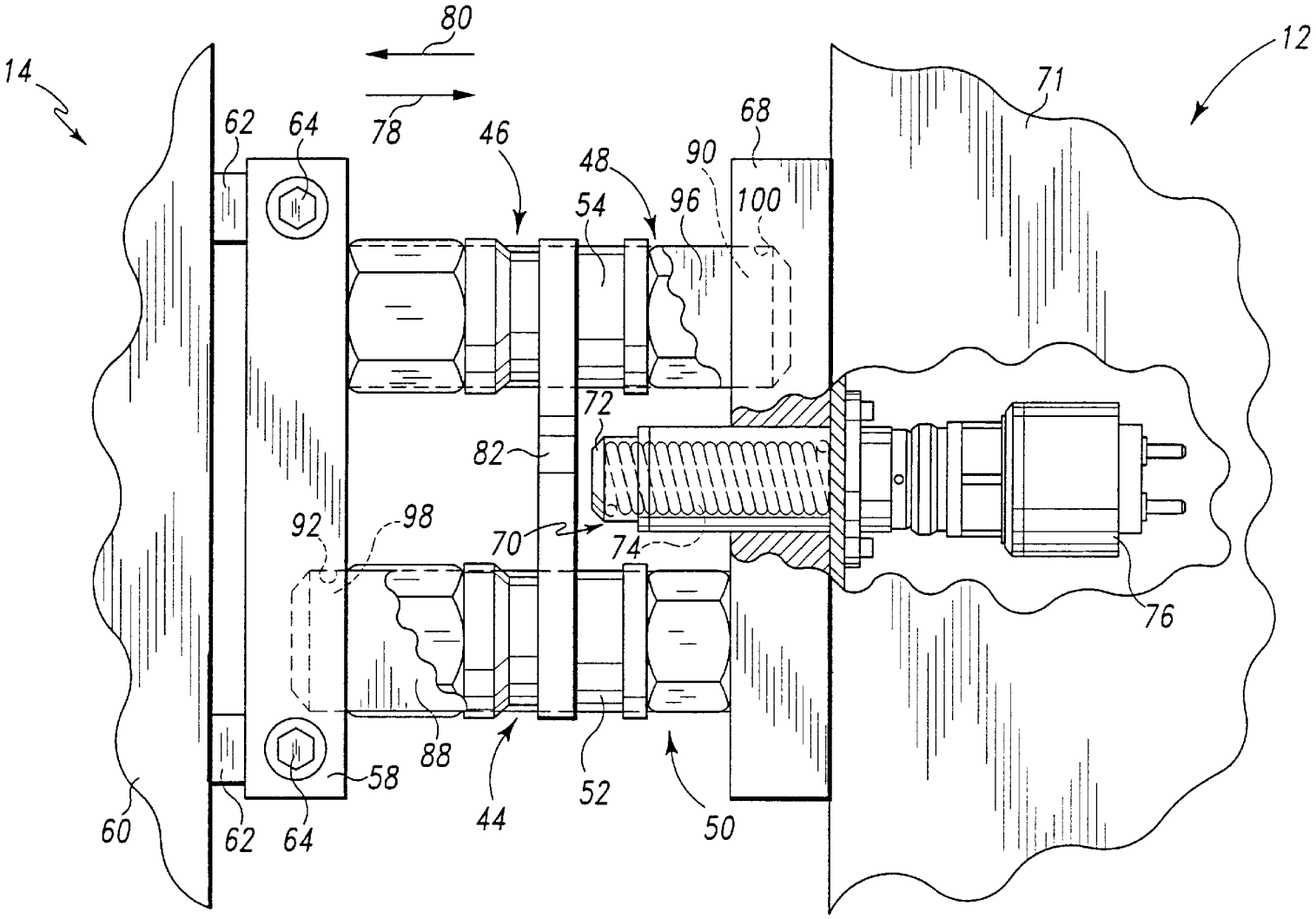
FIG. 9 is a view similar to FIG. 8, but showing the plunger in the retracted position so as to allow the female fluid couplings to be coupled to the male fluid couplings.

The male fluid coupling assembly 30 is then further advanced in the general direction of arrow 80 such that the alignment fingers 88, 90, 96, 98 begin to be advanced into the alignment recess 102, 100, 94, 92, respectively, as shown in FIG. 7. It should be appreciated that although the alignment fingers 88, 96 have been cut away in FIGS. 6–9 for clarity of description, the alignment fingers 88, 96 function in a similar manner as the alignment fingers 90, 98. In particular, as the alignment fingers 90, 98 are received into the alignment recesses 100, 92, respectively, as shown in FIG. 7, the alignment fingers 88, 96 are also received into the respective alignment recess 102, 94 (also not shown in FIGS. 6–9 for clarity of description).

As shown in FIG. 8, the plunger 72 is then positioned in the extended position so as to position the locking sleeves 52, 54 in their respective unlocked positions. In particular, upon actuation of the solenoid 76, the plunger 72 is positioned in the extended position so as to be advanced into contact with the release bar 82. Such contact with the release bar 82 causes the release bar 82 to be urged in the general direction of arrow 80 of FIG. 7 thereby likewise urging the locking sleeves 52, 54 in the general direction of arrow 80 and into their respective unlocked positions.

Once the male fluid couplings 48, 50 are fully received into the female fluid couplings 46, 44, respectively, the plunger 72 is positioned in the retracted position. In particular, the solenoid 76 is deactuated thereby allowing the spring bias of the spring 74 to return the plunger 72 to its retracted position thereby spacing the plunger 72 apart from the release bar 82. When the plunger 72 is spaced apart from the release bar 82, the locking springs (not shown) of the female fluid couplings 44, 46 urge the locking sleeves 52, 54, respectively, in the general direction of arrow 78 thereby returning the locking sleeves 52, 54 to their respective locked positions. It should be appreciated that when (1) the male fluid couplings 48, 50 are positioned in the open ended chambers 56 of the female fluid couplings 46, 44, respectively, and (2) the locking sleeves 52, 54 are positioned in their respective locked positions, the male fluid couplings 48, 50 are coupled to the female fluid couplings 46, 44, respectively, so as to allow advancement of fluid therebetween.

Once the male fluid couplings 48, 50 are coupled to the female fluid couplings 46, 44, respectively, the fluid control circuit 22 (see FIG. 1) may begin to supply operation pressure to the sweeper assembly 14 (see FIG. 1). In particular, when the male fluid coupling 48 is coupled to the female coupling 46, pressurized hydraulic fluid from the outlet of the fluid pump 24 is supplied to the hydraulic motor 28 via the fluid lines 34, 36 (see FIG. 1). Similarly, when the male fluid coupling 50 is coupled to the female fluid coupling 44, exhausted or spent hydraulic fluid is exhausted from the hydraulic motor 28 to the fluid reservoir 26 via the fluid lines 38, 40 (see FIG. 1).

In order to decouple the male fluid couplings 48, 50 from the female fluid couplings 46, 44, respectively, the plunger 72 is first positioned in its extended position. In particular, the solenoid 76 is actuated thereby urging the plunger 72 in the general direction of arrow 80 and into contact with the release bar 82. Such contact with the release bar 82 causes the release bar to be urged in the general direction of arrow 80 of FIGS. 6–9 thereby likewise urging the locking sleeves 52, 54 in the general direction of arrow 80 and into their respective unlocked positions as shown in FIG. 4. As discussed above, when the locking sleeves 52, 54 are positioned in their respective unlocked positions, fluid advancement through the female fluid couplings 44, 46 and the male fluid couplings 48, 50 is inhibited.

Once the locking sleeves 52, 54 have been positioned in their respective unlocked positions, the male fluid coupling assembly 30 and hence the male fluid couplings 48, 50 and the plunger 72 are advanced in the general direction of arrow 78. As the plunger 72 is spaced apart from the release bar 82, the locking springs (not shown) of the female fluid couplings 44, 46 urge the locking sleeves 52, 54 and hence the release bar 82 in the general direction of arrow 78 so as to return the locking sleeves to their respective locked positions.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

It should be appreciated that although (1) the female fluid couplings 44, 46 have been described herein as being secured to the sweeper assembly 14, and (2) the male fluid couplings 48, 50 have been described herein as being secured to the boom assembly 12, both of which have significant advantages thereby, many of the advantages of the present invention may be achieved by securing the fluid couplings 44, 46, 48, and 50 to other machine components. For example, the female fluid couplings 44, 46 may be position on the mechanical coupling assembly 16 of the boom assembly 12, while the male fluid couplings 48, 50 may be positioned on the mechanical coupling assembly 18 of the sweeper assembly 14. In such a configuration, the solenoid 76 may be mechanically coupled to the locking sleeves 52, 54 so as to upon actuation urge the locking sleeves 52, 54 into their respective unlocked positions prior to advancement of the boom assembly 12 and hence the female fluid couplings 44, 46 toward the sweeper assembly 14 and hence the male fluid couplings 48, 50.

Further, it should be appreciated that although the fluid-powered work implement 14 is herein described as a hydraulically-powered sweeper assembly, the present invention may be used to couple the male and female fluid couplings of other types of work implements. For example, the present invention may be used to couple a bucket having hydraulically-assisted apron or a hydraulically-powered grapple.

Moreover, the present invention is contemplated for use in conjunction with various types of work machines in addition to the tool carrier 10. For example, the present invention may be used to couple fluid-powered work implements to an excavator or a back hoe.

In addition, it should be appreciated that the present invention may be used in various types of fluid power circuits in addition to hydraulic power circuits. For example, the present invention may be used to couple components associated with a pneumatic power circuit.

What is claimed is:

1. A work machine, comprising:

a boom assembly;

a fluid-powered work implement;

a first male fluid coupling secured to said boom assembly;

a plunger movably secured to said boom assembly, said plunger being positionable between a first plunger position and a second plunger position; and a first female fluid coupling secured to said work implement, said first female fluid coupling having a first locking sleeve slidably secured thereto so as to be positionable between a first locked position and a first unlocked position, wherein (1) said plunger positions said first locking sleeve in said first unlocked position when said plunger is positioned in said first plunger position, and (2) said plunger allows said first locking sleeve to assume said first locked position when said plunger is positioned in said second plunger position.

2. The work machine of claim 1, further comprising a release member secured to said first locking sleeve, wherein:

said plunger contacts said release member so as to urge said first locking sleeve from said first locked position to said first unlocked position when said plunger is moved from said second plunger position to said first plunger position.

3. The work machine of claim 2, wherein:

said plunger is moved out of contact with said release member so as to allow said first locking sleeve to assume said first locked position when said plunger is moved from said first plunger position to said second plunger position.

4. The work machine of claim 1, further comprising:

a second male fluid coupling secured to said boom assembly; and a second female fluid coupling secured to said work implement, said second female fluid coupling having a second locking sleeve slidably secured thereto so as to be positionable between a second locked position and a second unlocked position, wherein (1) said plunger further positions said second locking sleeve in said second unlocked position when said plunger is positioned in said first plunger position, and (2) said plunger further allows said second locking sleeve to assume said second locked position when said plunger is positioned in said second plunger position.

5. The work machine of claim 4, further comprising a fluid pump and a fluid reservoir, wherein:

said work implement has a fluid motor secured thereto, said fluid motor has a fluid inlet and a fluid outlet, said fluid inlet is in fluid communication with said fluid pump when said first male fluid coupling is coupled to said first female fluid coupling, and said fluid outlet is in fluid communication with said fluid reservoir when said second male fluid coupling is coupled to said second female fluid coupling.

6. The work machine of claim 1, wherein:

said plunger is coupled to a solenoid, and actuation of said solenoid causes said plunger to move from said second plunger position to said first plunger position.

7. The work machine of claim 6, wherein:

a plunger spring biases said plunger toward said boom assembly, and deactuation of said solenoid allows said plunger spring to move said plunger from said first plunger position to said second plunger position.

8. The work machine of claim 1, wherein:

said work implement has an alignment finger attached thereto, said boom assembly has an alignment recess defined therein, and said alignment finger cooperates with said alignment recess so as to align said first male fluid coupling with said first female fluid coupling when said work implement is attached to said boom assembly.

9. A method of coupling a fluid-powered work implement to a boom assembly of a work machine, with (1) the boom assembly having a first male fluid coupling attached thereto, the boom assembly further having a plunger attached thereto, and (2) the work implement having a first female fluid coupling attached thereto, the first female fluid coupling having a first locking sleeve slidably secured thereto, comprising the steps of:

moving the boom assembly toward the work implement so as to align the first male fluid coupling with the first female fluid coupling;

actuating the plunger so as to cause the first locking sleeve to be moved from a first locked position to a first unlocked position;

further moving the boom assembly so as to advance the first male fluid coupling into the first female fluid coupling; and deactuating the plunger so as to cause the first locking sleeve to be moved from the first unlocked position to the first locked position.

10. The method of claim 9, wherein:

a release member is secured to the first locking sleeve of the first female fluid coupling, and the step of actuating the plunger includes the step of moving the plunger into contact with the release member so as to cause the first locking sleeve to be moved from the first locked position to the first unlocked position.

11. The method of claim 10, wherein:

the step of deactuating the plunger includes the step of moving the plunger out of contact with the release member so as to cause the first locking sleeve to be moved from the first unlocked position to the first locked position.

12. The method of claim 11, wherein:

the boom assembly further has a second male fluid coupling attached thereto, the work implement further has a second female fluid coupling attached thereto, the second female fluid coupling having a second locking sleeve slidably secured thereto, the release member is further secured to the second locking sleeve, the step of actuating the plunger includes the step of moving the plunger into contact with the release member so as to cause the second locking sleeve to be moved from a second locked position to a second unlocked position, and the step of deactuating the plunger includes the step of moving the plunger out of contact with the release member so as to cause the second locking sleeve to be moved from the second unlocked position to the second locked position.

13. The method of claim 12, wherein:

the work machine includes a fluid pump and a fluid reservoir, the work implement has a fluid motor secured thereto, the fluid motor has a fluid inlet and a fluid outlet, the fluid inlet is in fluid communication with the fluid pump when the first male fluid coupling is coupled to the first female fluid coupling, and the fluid outlet is in fluid communication with the fluid reservoir when the second male fluid coupling is coupled to the second female fluid coupling.

14. The method of claim 9, wherein:

the plunger is coupled to a solenoid, and the actuation step includes the step of actuating the solenoid so as to cause the first locking sleeve to be moved from the first locked position to the first unlocked position.

15. The method of claim 14, wherein:

a plunger spring biases the plunger toward the boom assembly, and the deactuation step includes the step of deactuating the solenoid so as to allow the plunger spring to move the plunger toward the boom assembly thereby causing the first locking sleeve to assume the first locked position.

16. The method of claim 9, wherein:

the work implement has an alignment finger attached thereto, the boom assembly has an alignment recess defined therein, and the step of moving the boom assembly toward the work implement includes the step of advancing the alignment finger into the alignment recess so as to align the first male fluid coupling with the first female fluid coupling.

17. A work machine, comprising:

a first machine component;

a second machine component;

a first fluid coupling secured to said first machine component;

a plunger movably secured to said first machine component, said plunger being positionable between a first plunger position and a second plunger position; and a second fluid coupling secured to said second machine component, said second fluid coupling being positionable between a locked position and an unlocked position, wherein (1) said plunger positions said second fluid coupling in said first unlocked position when said plunger is positioned in said first plunger position, and (2) said plunger allows said second fluid coupling to assume said first locked position when said plunger is positioned in said second plunger position.

18. The work machine of claim 17, further comprising a release member secured to said second fluid coupling, wherein:

said plunger contacts said release member so as to urge said second fluid coupling from said locked position to said unlocked position when said plunger is moved from said second plunger position to said first plunger position.

19. The work machine of claim 18, wherein:

said plunger is moved out of contact with said release member so as to allow said second fluid coupling to assume said locked position when said plunger is moved from said first plunger position to said second plunger position.

20. The work machine of claim 17, wherein:

said first machine component includes a boom assembly having (1) said first fluid coupling secured thereto, and (2) said plunger movably secured thereto, and said second machine component includes a fluid-powered work implement having said second fluid coupling secured thereto.

* * * * *